US009435132B1

(12) United States Patent
Wagner

(10) Patent No.: US 9,435,132 B1
(45) Date of Patent: Sep. 6, 2016

(54) POOL SWEEPER

(71) Applicant: Rickey Lee Wagner, Reedsville, PA (US)

(72) Inventor: Rickey Lee Wagner, Reedsville, PA (US)

( * ) Notice: Subject to any disclaimer, the term of this patent is extended or adjusted under 35 U.S.C. 154(b) by 99 days.

(21) Appl. No.: 14/299,313

(22) Filed: Jun. 9, 2014

Related U.S. Application Data

(63) Continuation-in-part of application No. 14/023,985, filed on Sep. 11, 2013, now abandoned.

(60) Provisional application No. 61/699,464, filed on Sep. 11, 2012.

(51) Int. Cl.
*E04H 4/16* (2006.01)
*E04H 4/12* (2006.01)

(52) U.S. Cl.
CPC ..... *E04H 4/1209* (2013.01); *E04H 4/1618* (2013.01)

(58) Field of Classification Search
CPC . E04H 4/1609; E04H 4/1618; E04H 4/1636; E04H 4/1209
USPC ..... 210/136, 167.16, 167.17, 238, 416.1, 210/416.2, 767
See application file for complete search history.

(56) References Cited

U.S. PATENT DOCUMENTS 3,820,182 A * 6/1974 Vockroth ..... E04H 4/16 15/1.7
4,584,733 A * 4/1986 Tietge ..... E04H 4/16 15/1.7
4,935,908 A * 6/1990 Bull ..... G01H 3/12 310/800
5,095,571 A * 3/1992 Sargent ..... E04H 4/1609 15/1.7
5,122,285 A * 6/1992 Tartal ..... B01D 21/245 134/34
5,135,647 A * 8/1992 Childers ..... B01D 29/23 15/1.7
5,338,452 A * 8/1994 Pidaparti ..... C02F 3/28 210/188
5,542,142 A * 8/1996 Young ..... E04H 4/1609 15/1.7
6,019,891 A * 2/2000 Stoner ..... E04H 4/1609 15/1.7
6,248,232 B1 * 6/2001 Stoner ..... E04H 4/1609 15/1.7
7,060,182 B2 * 6/2006 Erlich ..... E04H 4/1636 134/168 R
7,090,769 B1 * 8/2006 Peterson ..... E04H 4/1636 134/22.1
2005/0126969 A1 * 6/2005 Dolton ..... E04H 4/1609 210/167.17
2006/0064825 A1 * 3/2006 Reed ..... E04H 4/1636 15/1.7

* cited by examiner

*Primary Examiner* — Fred Prince
(74) *Attorney, Agent, or Firm* — John J. Elnitski, Jr.

(57) ABSTRACT

A pool sweeper for removing debris from underwater. The pool sweeper has a pump housing and a pump shaft movably mounted in the pump housing. The pool sweeper has a plunger attached to the pump shaft. The pool sweeper has a bag extension attached to a connection port of the pump housing. The pool sweeper has a first collection one-way valve which opens during pulling of the pump shaft. The pool sweeper has a collection port connected to the bag extension between the first collection one-way valve and a second end of the bag extension. The pool sweeper has a second collection one-way valve which opens during pushing of the pump shaft. The pool sweeper has a container connected to the exit of the collection port.

16 Claims, 13 Drawing Sheets

POOL SWEEPER

This application is a continuation-in-part application of U.S. patent application Ser. No. 14/023,985 filed Sep. 11, 2013 and claims the benefit and incorporates by reference U.S. patent application Ser. No. 14/023,985 filed Sep. 11, 2013 and U.S. Provisional Application No. 61/699,464 filed Sep. 11, 2012

BACKGROUND

The present invention generally relates to swimming pool sweepers. More specifically, the present invention relates to manually operated swimming pool sweepers.

There are powered pool sweepers and manually operated pool sweepers. Most of the powered pool sweepers attach to the pool filter system of a pool. The filter system provides the vacuum power for the pool sweeper to pick up debris. There are two types of powered pool sweepers that use the pool filter system. They are hand held and automated. The hand held pool sweepers typically use a pole with a nozzle on the end, so that the user can move the nozzle around the pool to pick up debris. The automated pool sweeper are motorized and run around on the pool bottom in random patterns. There are also electrically powered pool sweepers that typically mimic the hand held powered pool sweepers and have battery packs. Powered hand held pool sweepers are usually bulky to move due to their connection to the filter system or due to the weight of the external battery packs. The external battery packs also require the user to make sure the battery packs are charged. Manual pool sweepers provide the advantage of removing the requirement of being connected to the filter system or use of battery packs. Manual pool sweepers also provide the advantage of being easy to manipulate due to not being connected to the pool filter system or having the added weight of the battery packs to move about. Unfortunately, the manual pool sweepers are difficult to operate in another manner, due to the force needed to be provided by the user to cause the proper suction. What is needed is a more effective manual pool sweeper.

It is an object of the present invention to provide a manual pool sweeper to collect debris.

SUMMARY OF THE INVENTION

A pool sweeper for removing debris from underwater. The pool sweeper has a pump housing and a pump shaft movably mounted in the pump housing. The pool sweeper has a plunger attached to the pump shaft. The pool sweeper has a bag extension attached to a connection port of the pump housing. The pool sweeper has a first collection one-way valve which opens during pulling of the pump shaft. The pool sweeper has a collection port connected to the bag extension between the first collection one-way valve and a second end of the bag extension. The pool sweeper has a second collection one-way valve which opens during pushing of the pump shaft. The pool sweeper has a container connected to the exit of the collection port.

DETAILED DESCRIPTION

Figure 1:
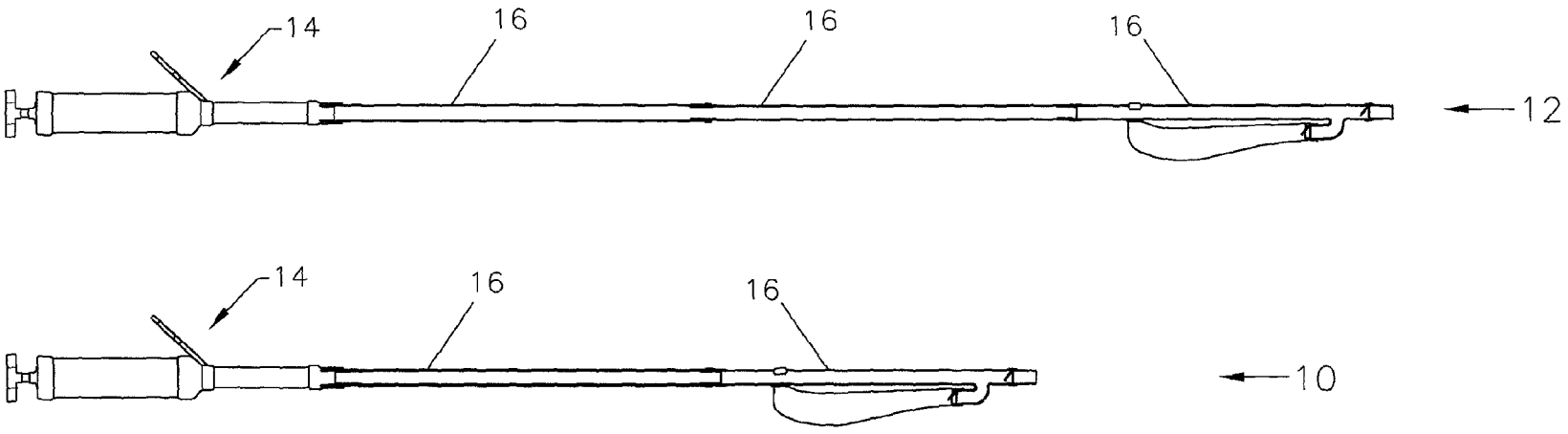
FIG. 1 is a side view of a pool sweeper according to the present invention.
Figure 2:
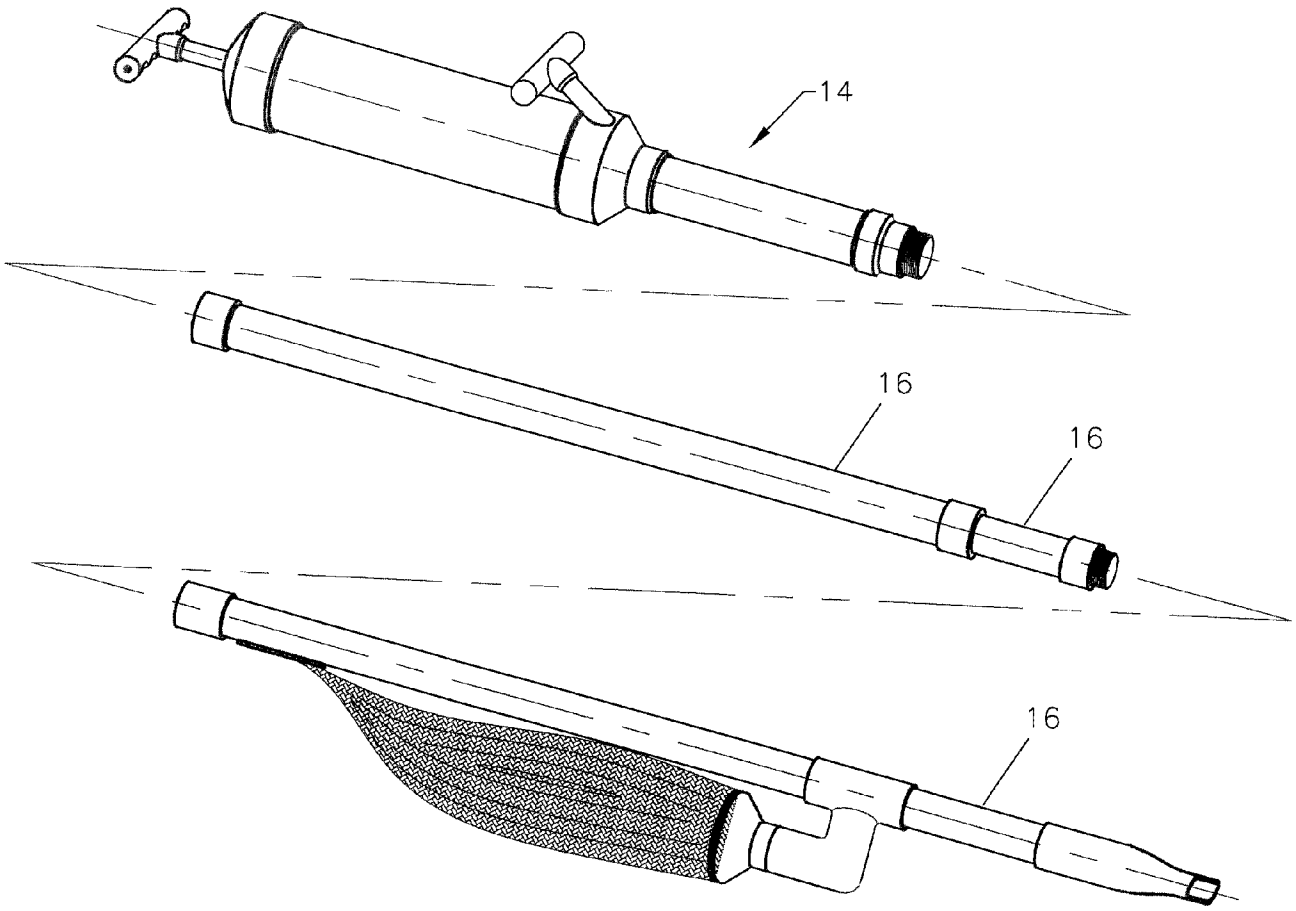
FIG. 2 is a perspective exploded view of a pool sweeper according to the present invention.

The present invention is a pool sweeper used to manually vacuum debris from a swimming pool bottom, such as leaves and bugs and other small debris that are typically found underwater. FIG. 1 shows an embodiment 10 and an embodiment 12. Each of the embodiments 10 and 12 include a pump assembly 14 and extensions 16. The difference between the embodiments 10 and 12 is that embodiment 12 includes an additional extension 16. It is also possible to use the pool sweeper with only one extension 16 attached to the pump assembly 14. FIG. 2 shows a closer view of the pool sweeper, whereby there are three extensions 16 with a telescoping feature to compact the extensions 16 together.

Figure 3:
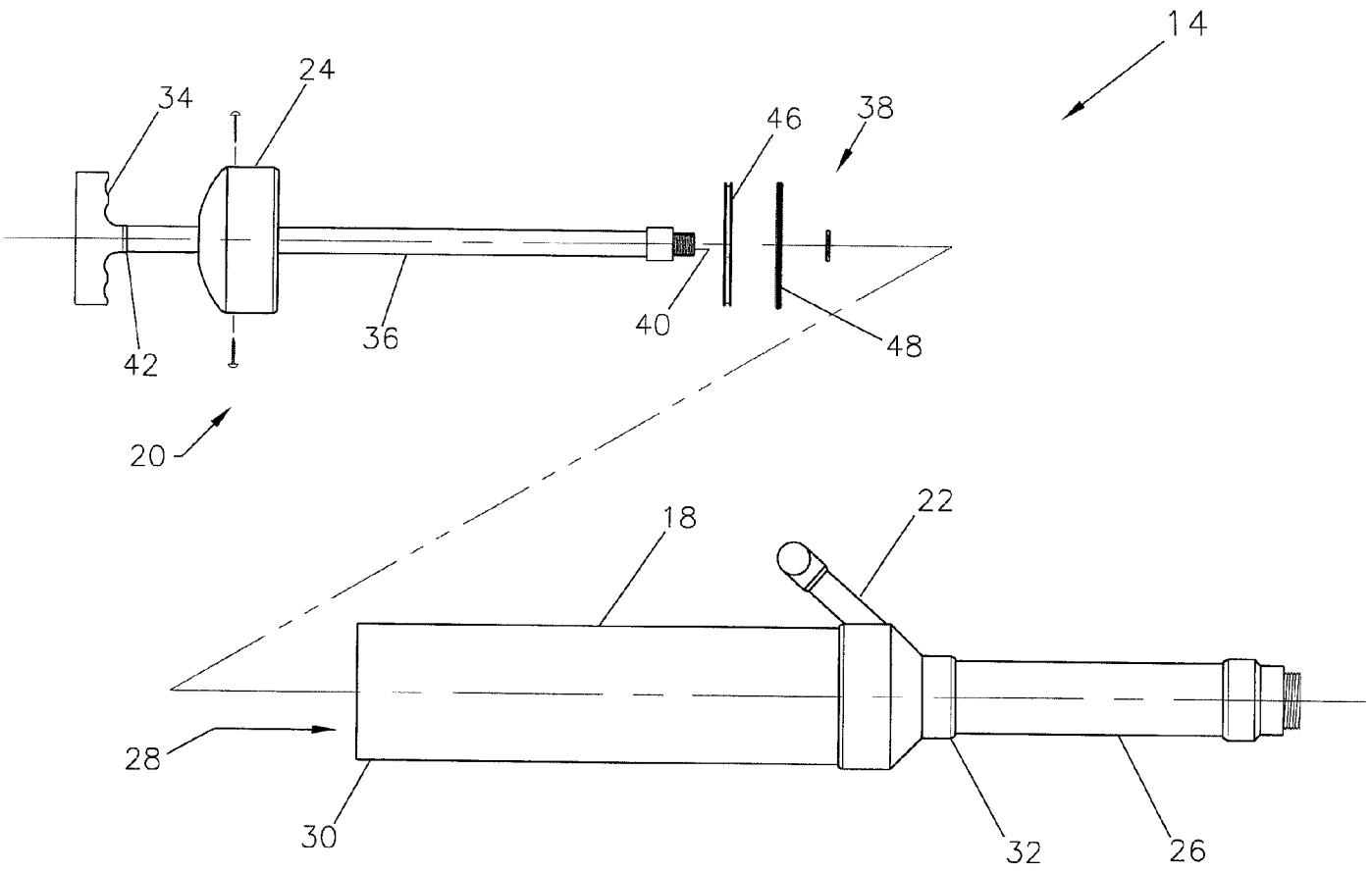
FIG. 3 is an exploded side view of a section of a pool sweeper according to the present invention.
Figure 4:
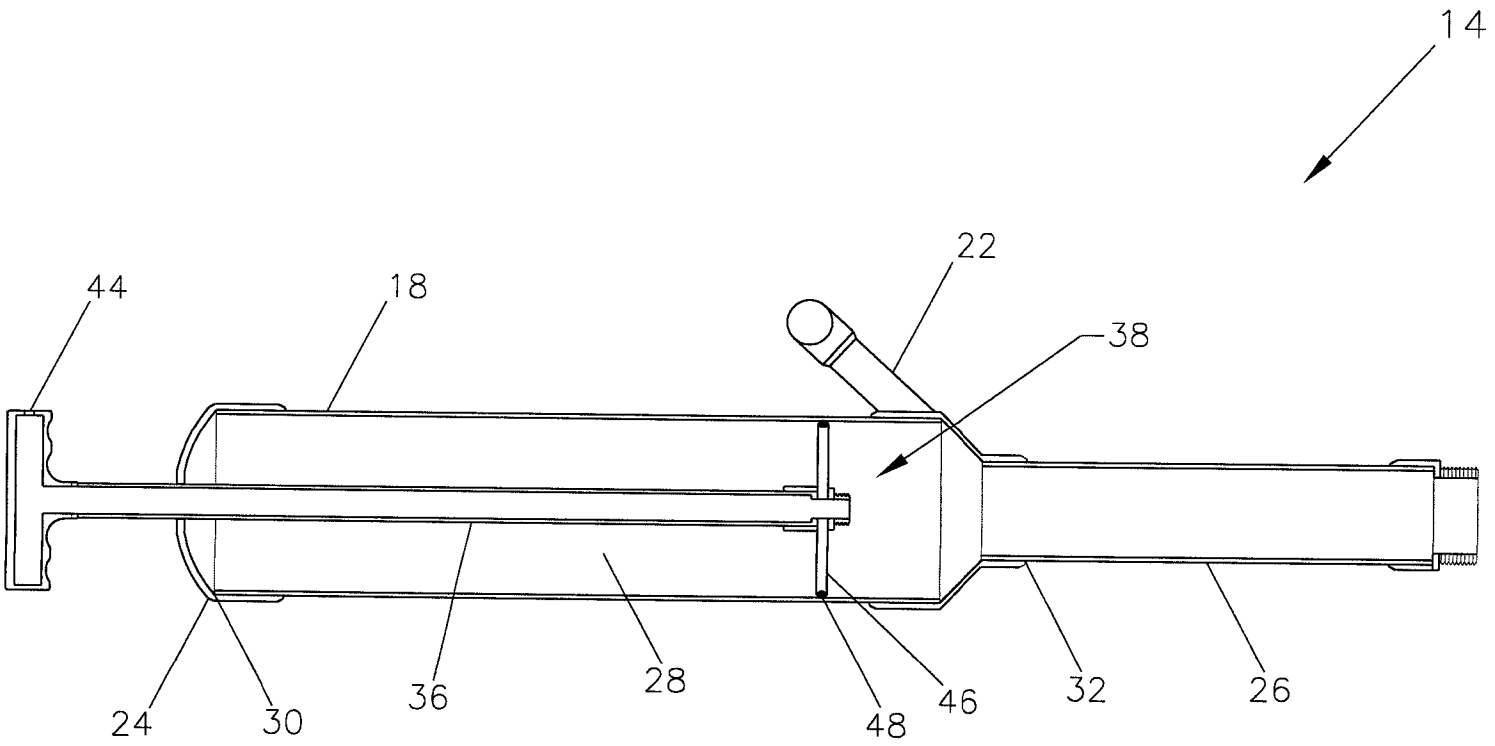
FIG. 4 is a cutaway side view of a section of a pool sweeper according to the present invention.

FIGS. 3-4 show more detail of the pump assembly 14. The pump assembly 14 includes a pump housing 18, pump handle assembly 20, support handle 22, end cap 24 and connection port 26. The pump housing 18 includes pump chamber 28 inside the pump housing 18. The end cap 24 secures and seals a first end 30 of the pump housing 18. The connection port 26 extends from a second end 32 of the pump housing 18 for connections of the extensions 16. The pump handle assembly 20 includes a pump handle 34, pump shaft 36 and seal assembly 38. The pump shaft 36 is hollow and has an opening at first end 40. The pump handle 34 is connected to the pump shaft 36 at a second end 42. The pump handle 34 is also hollow with a thumb hole 44, such there is an open airway from the first end 40 of the pump shaft 36 to the thumb hole 44 of the pump handle 34. The thumb hole 44 acts as an air release for the pool sweeper. The seal assembly 38 includes a solid seal disc 46 with a rubber seal 48 around the outside of the seal disc 46. The seal disc 46 is a plunger. The seal disc 46 connects about the first end 40 of the pump shaft 36 to provide a seal between the pump shaft 36 and the pump chamber 28. The support handle 22 is shown connected to the pump assembly 14 and provides support to the user when operating the pool sweeper.

Figure 5:
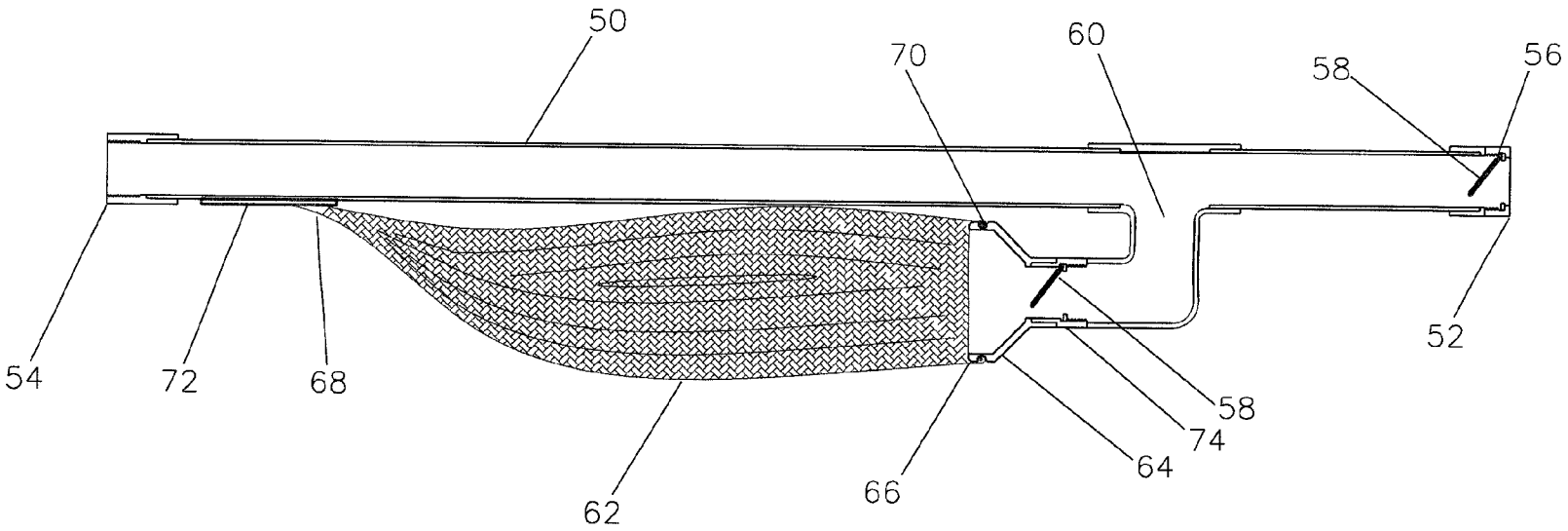
FIG. 5 is a cutaway side view of a section of a pool sweeper according to the present invention.
Figure 6:
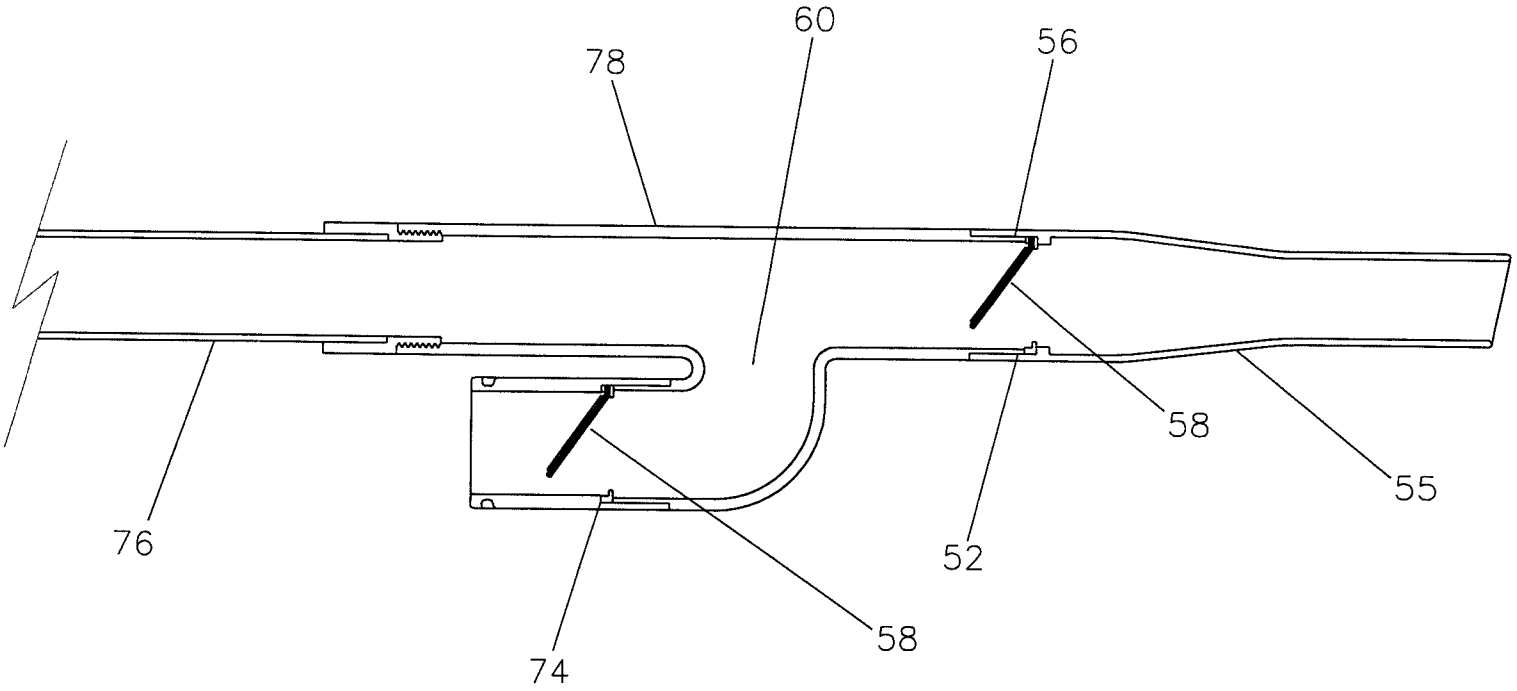
FIG. 6 is a cutaway side view of a section of a pool sweeper according to the present invention.
Figure 7:
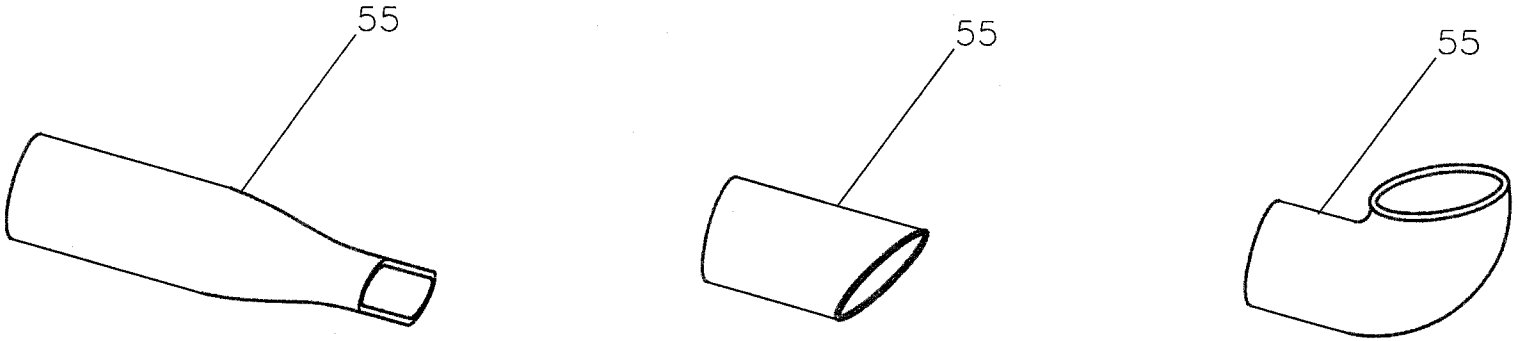
FIG. 7 is a perspective view of nozzles for a pool sweeper according to the present invention.

The pool sweeper will have at least one extension 16 connected to the connection port of the pump assembly 14 referred to as the bag extension. FIGS. 5 and 6 show two extension configurations for the bag extension 50. FIG. 5 shows the bag extension 50 having a first end 52 and a second end 54. The second end 54 of the bag extension 50 is for connection to the connection port 26 of the pump assembly 14 or to another extension 16. The first end 52 is for connection of the nozzle to bag extension 50. FIG. 7 shows different nozzle shapes 55 that can be used on the first end 52 of the bag extension 50. Located near the first end 52 of the bag extension 50 is a first collection one-way valve 56 to allow the entrance of water and debris into the bag extension 50. The first collection one-way valve 56 is shown as a hinged rubber flap 58 which opens toward the second end 54 and closes towards the first end 52 of the bag extension 50. Between the first end 52 and second end 54 of the bag extension 50 is a collection port 60. The collection port 60 has an opening in the bag extension 50 that leads to a mesh collection bag 62. The collection port 60 includes a bag end 64 for connection of the collection bag 62. The bag end 64 of the collection port 60 is an exit for the collection port 60. The collection bag 62 includes a first end 66 and a second end 68. The first end 66 of the collection bag 62 includes an opening to mount the collection bag 62 to bag end 64 of the collection port 60. FIG. 5 shows the first end 66 of the collection bag 62 slipped over the bag end 64 and held in place by an elastic band 70. The second end 68 of the collection bag 62 is closed and attached to a bag clip 72 to hold the second end 68 of the collection bag 62 in place on the bag extension 50. The collection bag 62 is shown stretched along the length of the collection bag 62 to allow for the collection bag 62 to be used effectively. The length of the bag extension 50 should be at least the length of the collection bag 62, so that the collection bag 62 is stretched out. Included at the bag end 64 is second collection one-way valve 74 to allow the entrance of water and debris into the collection bag 62. The second collection one-way valve 74 is shown as a hinged rubber flap 58 which opens toward the collection bag 62 and closes towards the opening of the collection port 60. FIG. 6 shows a second bag extension configuration of two parts. The two parts are an extension 76 and input end 78. The input end 78 includes the first end 52 for connection of a nozzle, the first collection one-way valve 56, the collection port 60 and the second collection one-way valve 74. The input end 78 includes a second end 80 for connection to the extension 76. The separable input end 78 allows reducing the overall size during break down as compared to the bag extension 50 of FIG. 5. The extension 76 is used due to the length of the collection bag 62 needing to be stretched out. Other means could be used to replace the mesh collection bag 62, as long as it had holes to allow the water to flow out while retaining the debris.

Figure 8:
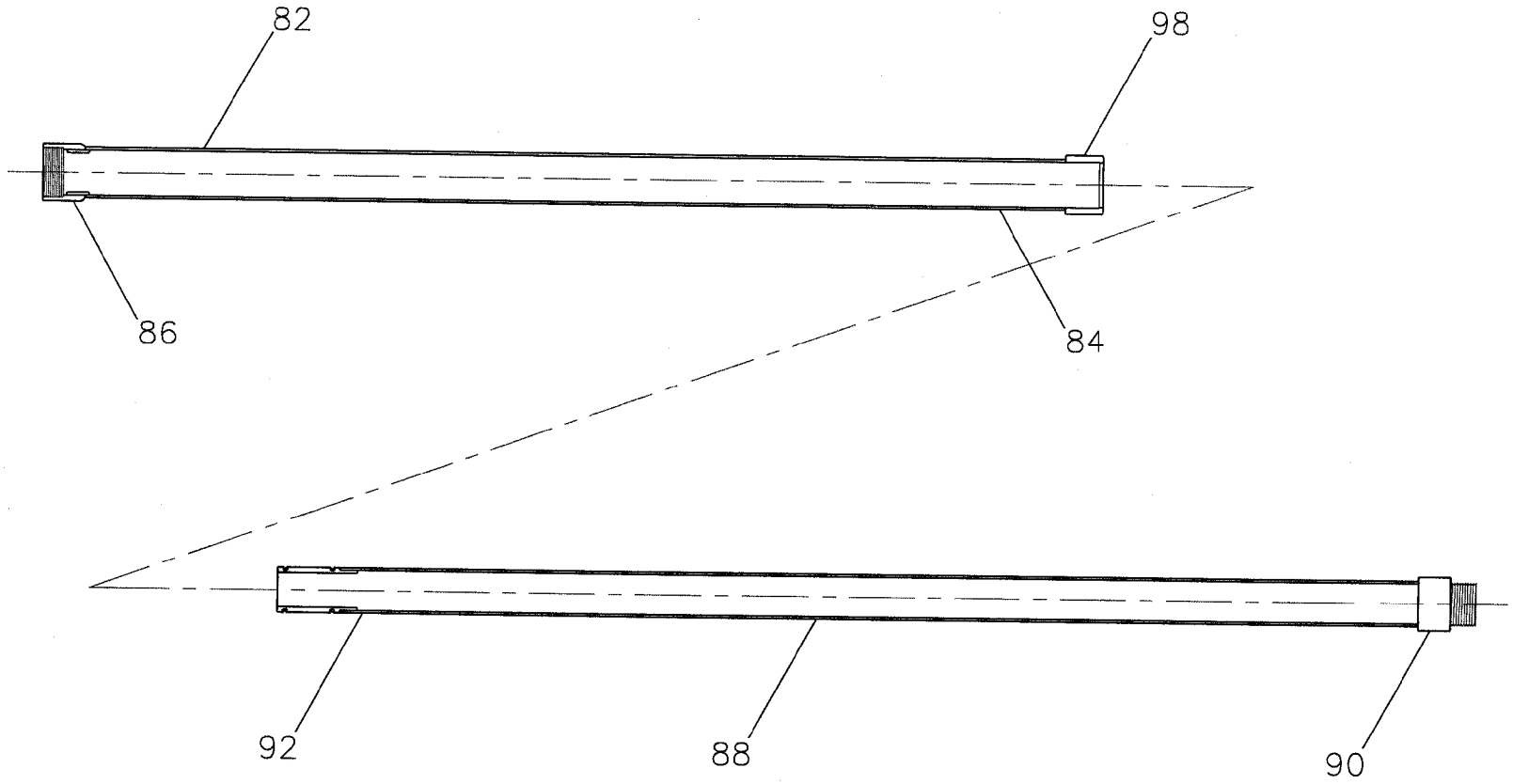
FIG. 8 is a cutaway side view of a section of a pool sweeper according to the present invention.
Figure 9:
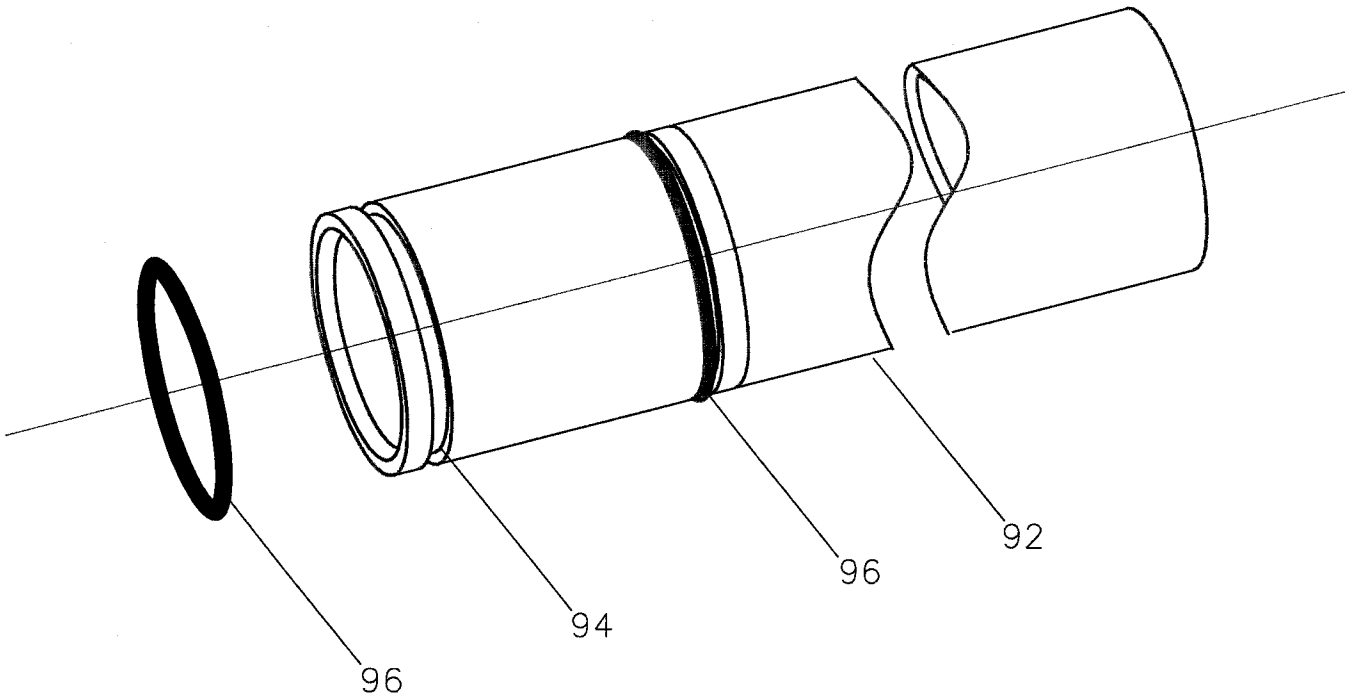
FIG. 9 is a perspective view of an end of an extension for a pool sweeper according to the present invention.
Figure 10:
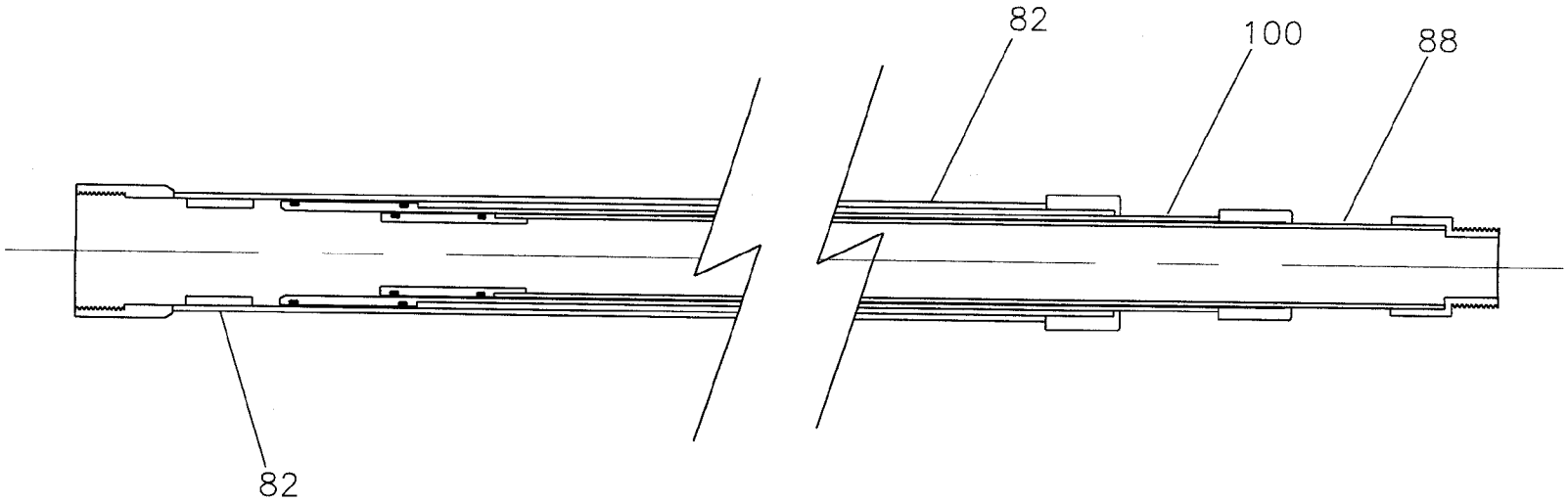
FIG. 10 is a cutaway side view of a section of a pool sweeper according to the present invention.

FIGS. 8-9 show more detail on the extensions 16 of FIGS. 1-2. FIG. 8 shows two extensions. There is a pump assembly extension 82 with a first end 84 and a second end 86. There is middle extension 88 with a first end 90 and a second end 92. The pump assembly extension 82 includes female threads inside the second end 86 of the pump assembly extension 82 to allow attachment to the connection port 26 of the pump assembly 14. The connection port 26 is shown with male threading to allow the second end 86 of the pump assembly extension 82 to be screwed onto the connection port 26 of the pump assembly 14. The middle extension 88 includes male threading on the first end 90 of the middle extension 88 to allow attachment to the bag extension 50 shown in FIG. 5 or extension 76 of the bag extension shown in FIG. 6. The bag extension 50 is shown with female internal threading within the second end 50 of the bag extension 50 to allow the second end 54 of the bag extension 50 to be screwed onto the middle extension 88. The extension 76 would also have female internal threading at one end. The second end 92 of the middle extension 88 is a seal end, as shown in FIG. 9. The second end 92 of the middle extension 88 includes two grooves 94 distanced apart from each other. The grooves 94 receive flexible O-ring seals 96. The second end 92 of the middle extension 88 fits into the first end 84 of the pump assembly extension 82. The two O-ring seals 96 provide an air tight connection between the pump assembly extension 82 and the middle extension 88, yet allow the middle extension 88 to move telescopically inside the pump assembly extension 82 to change the length of the pool sweeper. In FIG. 8, an end cap 98 is shown to fit over the first end 84 of the pump assembly extension 82. The end cap 98 allows the passage of the middle extension 88. FIG. 10 shows an additional extension 100 nested into the middle extension 88. Multiple extensions can be added to achieve a total desired length. It also allows the pool sweeper to be disassembled the parts to a manageable length for shipping and storage by the end user.

The extensions 88 and 100 are movable within the other extensions to vary the total length during use due to the dual O-ring design. The extensions 88 and 100 do not have to be fully extended for the pool sweeper to operate. The two O-ring seals 96 with separation provide s unique function within the assembly of the extension. The O-ring separation of about 2 inches provides lateral bending stability to an extension when extended from another extension. A single O-ring would allow for a significant degree of bend at each end when an extension is extended from another extension. The dual O-ring design negates any significant bend issues. The area in the gap between the O-rings provides a sealed storage area for lightweight vacuum grease to be permanently applied and stored. The vacuum grease is released slowly to the O-rings in small amounts during movement of an extension within another extension. The dual O-rings allows for a dynamic seal that only requires a light pull force supplied by the user to extend an extension. The dual O-rings also provide a static pressure on the inside walls of the extension, where the O-ring within helps keep the extended extension in place at a desired length during use. As an extension remains in a desired static position for a short time, the continuous pressure supplied by the O-rings squeeze any remaining lubricant at the sealing interface to the edges of the O-rings. If outer of thin-wall plastic tubing is used as the material for the extension, the continuous pressure supplied by the O-rings causes a micro deflection of the outer thin-wall plastic tubing. These two actions combined to increase the static holding force of the extensions by the O-ring assemblies to further insure the extension remains in the desired position for the user.

The pump assembly 14 provides the suction and pressure necessary to operate the pool sweeper. A user holding their thumb over the hole 44 in the pump handle 34, while manually pumping the pump shaft 36 in and out, will create a pushing and sucking action within the pump chamber 28. The pushing and sucking action is due to movement of the seal assembly 38 in the pump chamber 28. The sucking action is a pulling force. When the user pulls the pump shaft 36 outward, it creates enough suction to ingest water and debris near the first end 52 of the bag extension 50. During the pulling action, the first collection one-way valve 56 opens to allow the ingestion of the water and debris into the extensions 16. The pump housing 14 is shown as a larger diameter than the connection port 26 and the extensions 16. The change in diameter from the pump chamber 28 to extensions 16 increases the velocity of flow at the bag extension 50. The resulting high velocity flow provides sufficient suction force necessary to ingest the water and debris in close proximity to the first end 50 of the bag extension 50. There is a negative pressure created in the pool sweeper during pulling which opens the first collection one-way valve 56. The negative pressure also pulls and retains the second collection one-way valve 74 in a closed and sealed position to prevent anything in the mesh collection bag 62 from entering the collection port 60.

As the user pushes on the pump handle 34 while covering the hole 44 on the pump handle 34, positive pressure is produced. The positive pressure pushes on the water in the pump chamber 28 and the extensions 16 and causes the first collection one-way valve 56 to close. The positive pressure also causes the second collection one-way valve 74 to open. The opening of the second collection one-way valve 74 allows the water and debris to flow out of the collection port 60 and into the collection bag 62. Since the collection bag 62 is mesh, the water flows out of the collection bag 62, while the debris are retained in the collection bag 62. Where, the collection bag 62 acts as a filter. The pump shaft 36 can be cycled by the user to pick debris until the collection bag 62 is full. When the collection bag 62 is full, the collection bag 62 can be removed and emptied. To remove the pool sweeper from the pool, user simply uncovers the hole 44 on the pump handle 34 to release the pressure in the pool sweeper. Uncovering the hole 44 allows ambient pressure to enter the pool sweeper and allows gravity to pressurize the remaining water in the pool sweeper. This causes the water to force the second collection one-way valve 74 open and drain from the pool sweeper during removal from the water.

A prototype was manufactured using an inside diameter of 4.13 inches for the pump chamber 28 and 1.51 inch inside diameter at the first end 52 of the bag extension 50. A 1.5 inch pipe was connected connection port 26 of the pump housing 14 to act as the pump assembly extension 82. The inside diameter of the middle extension 88 was 1.72 inches and inside diameter of the bag extension 50 was 1.51 inches. The reduction in size from the 4.13 inches at the pump housing 14 to 1.51 inch at the first end 52 of the bag extension 50 in diameter produces a Ratio of the Area of the diameters of 7.4 and causes a suction velocity increase during pulling of the pump handle 34. The change in diameter from the first end 52 of the bag extension 50 to the pump chamber 28 aids in the pulling of water and debris into the pool sweeper and makes the pool sweeper more efficient than if a single diameter is used.

Figure 11:
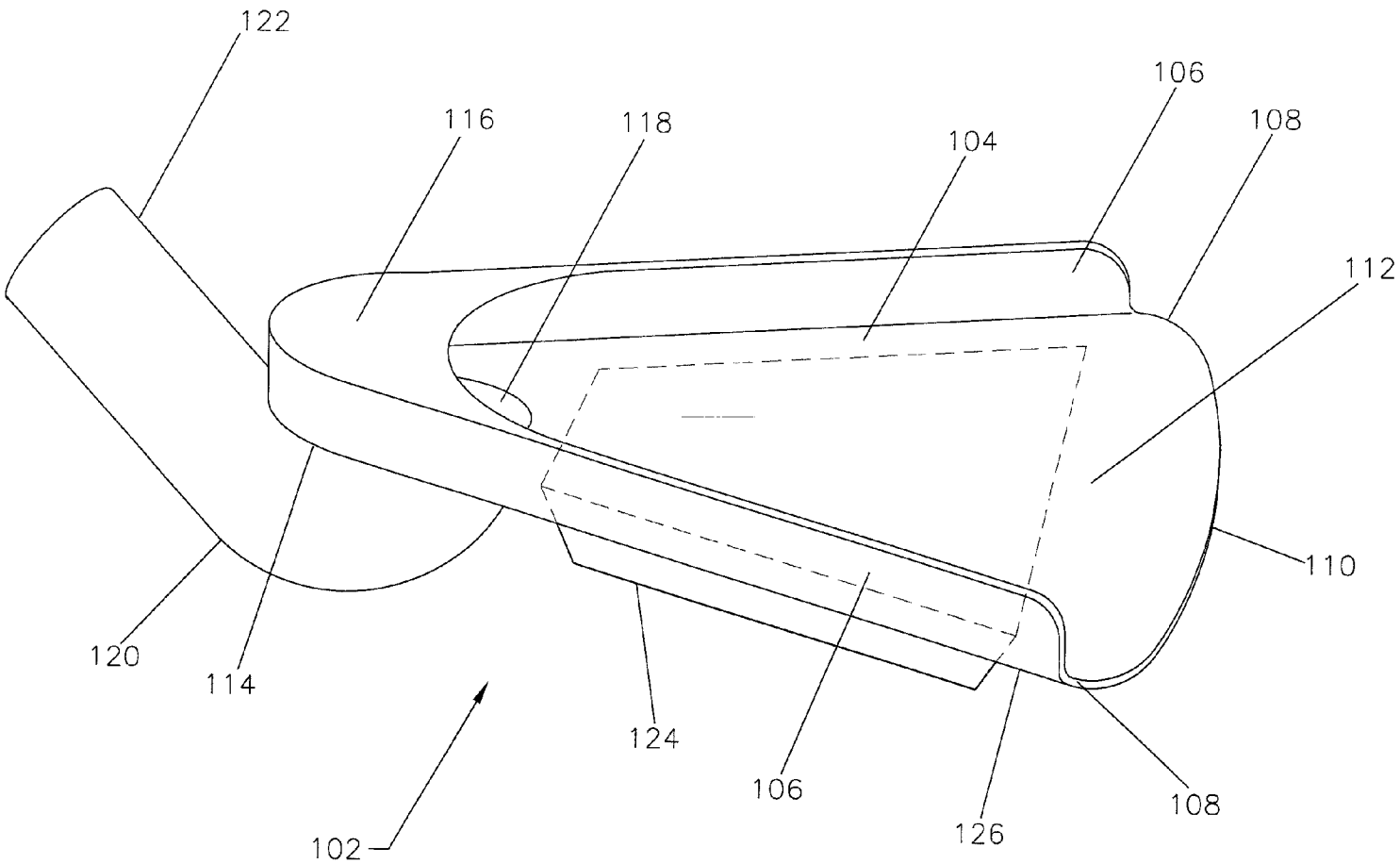
FIG. 11 is a perspective view of a nozzle of a pool sweeper according to the present invention.
Figure 12:
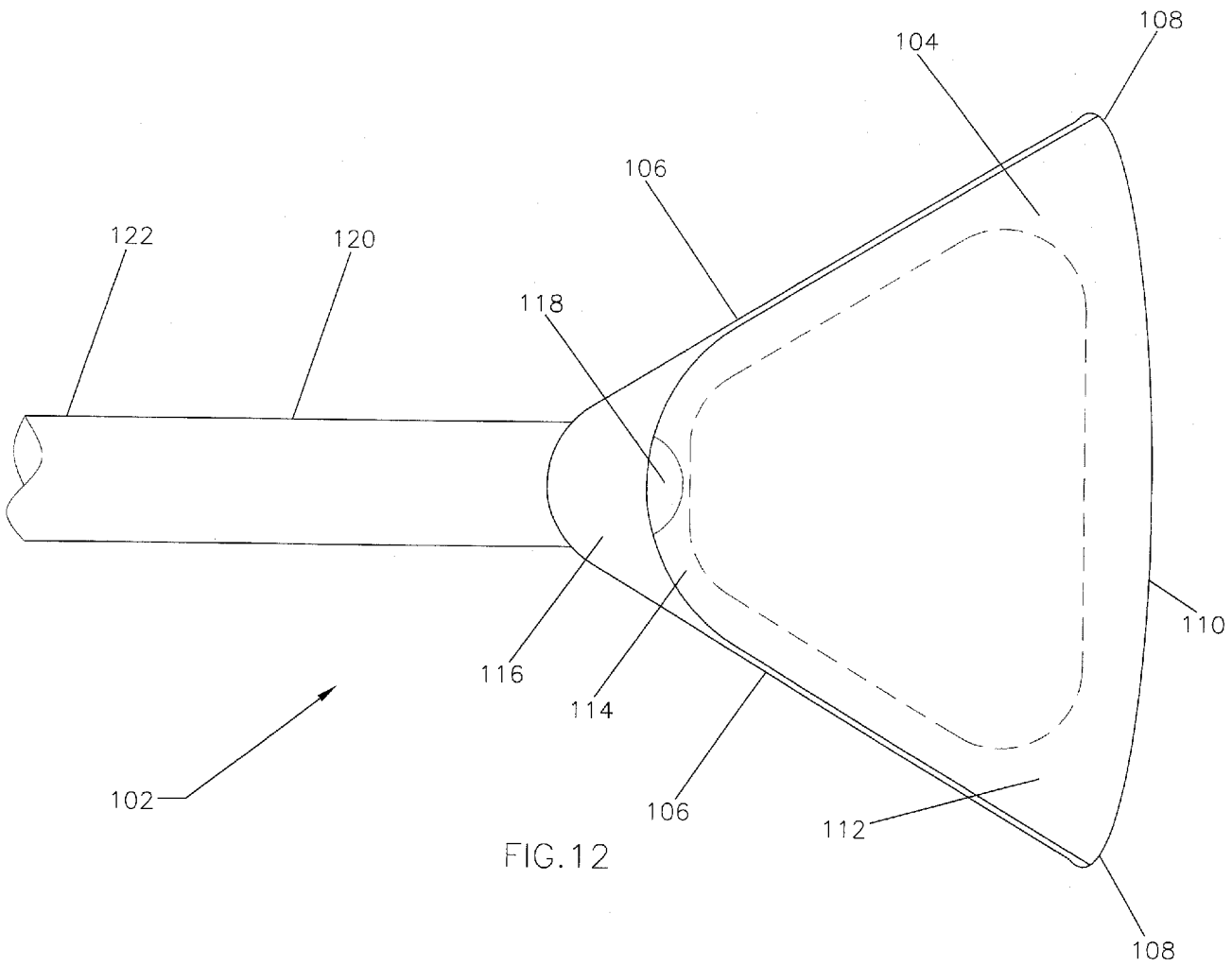
FIG. 12 is a top view of a nozzle of a pool sweeper according to the present invention.
Figure 13:
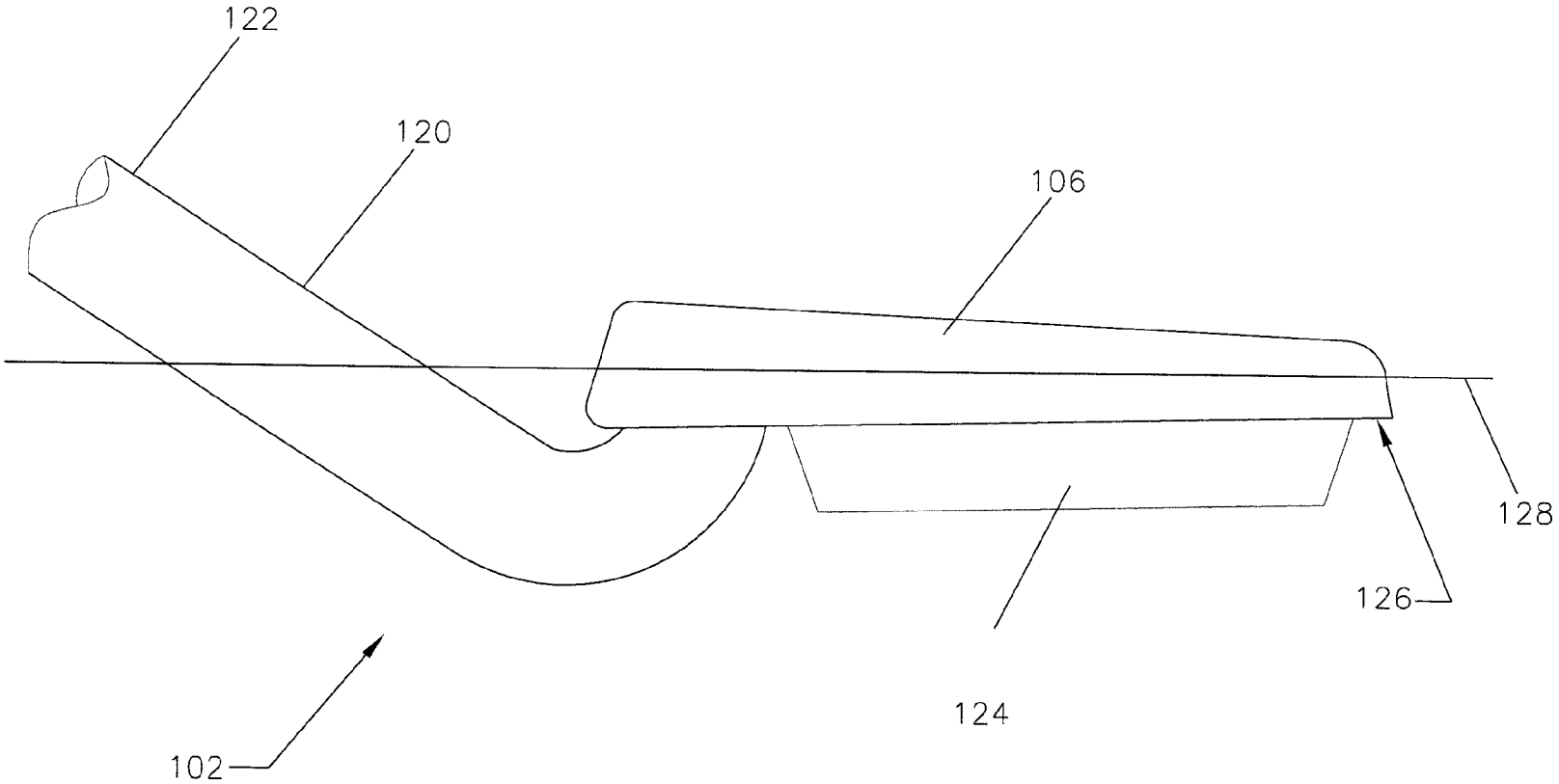
FIG. 13 is a side view of a nozzle of a pool sweeper according to the present invention.

FIGS. 11-13, show a skimmer nozzle 102 for attachment to the first end 52 of the bag extension 50 of the pool sweeper. The skimmer nozzle 102 includes collection surface 104 with side walls 106. The side walls 106 each start the ends 108 of an entrance 110 of the collection surface 104 and extend upward from a top 112 of the collection surface 104. The side walls 106 increase in height towards the rear 114 of the collection surface 104. As the side walls 106 reach the rear 114 of the collection surface 104, the side walls 106 form a collection box with a collection box top 116. At the rear 114 of the collection surface 104 is an intake port 118 in the top 112 of the collection surface 104. The intake port 118 is an opening that leads to a J-shaped tube 120 acting as a collection tube. The J-shaped tube 120 drops down and then angles upward to an extension end 122 of the J-shaped tube 120. The extension end 122 of the J-shaped tube 120 connects to the first end 52 of the bag extension 50. A floatation block 124 is mounted to the bottom 126 of the collection surface 104. The floatation block 126 is sized and made of a material to allow the collection surface 104 to float just below the water surface 128, shown in FIG. 13. For the best performance, the collection surface 104 would float between one-quarter to one-half inches below the water surface 128. When the user pulls on the pump handle 34, water and debris along the water surface 128 will be pulled into the intake port 118 and into the bag extension 50 to be forced into the collection bag 62.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A pool sweeper for removing debris from underwater, comprising:

a pump housing, said pump housing including a pump chamber inside said pump housing, said pump chamber for pulling water into said pool sweeper; said pump housing including a first end and a second end;

a connection port as part of said second end of said pump housing, said connection port providing entrance to said pump chamber;

a pump shaft movably mounted to said first end of the pump housing, said pump shaft mounted such that said pump shaft moves in and out of said first end of the pump housing and thereby moving in and out of said pump chamber, said pump shaft having a first end inside said pump chamber and a second end outside said pump chamber, said pump shaft including an opening at said first end of said pump shaft that is open to said pump chamber, said pump shaft including an open passage leading from said opening at said first end of said pump shaft;

a release opening outside said pump housing that is connected to said open passage of said pump shaft, said release opening being closable to provide pressure during pumping;

a pump handle attached to said second end of said pump shaft to provide a hand hold to actuate movement of said pump shaft;

a plunger attached to said pump shaft that is within said pump chamber, said plunger including a plunger seal about said plunger to interact with an inside wall of said pump housing which forms said pump chamber, said plunger and plunger seal forming sealed separation between said first end and said second end of said pump housing within said pump chamber;

a bag extension attached to said connection port, said bag extension including a first end and a second end with an open passage between said first and said second end of said bag extension, said first end and said second end of said bag extension being open and adapted to allow the entrance and exit of water and debris between said first end and said second end of said bag extension, said first end of said bag extension adapted for use of collection of water and debris, said second end of said bag extension for connection to said connection port of said pump housing, a first collection one-way valve which opens during pulling of said pump shaft away from said connection port of said pump housing adapted to allow pulling of water and debris into said bag extension and which closes during pushing of said pump shaft toward said connection port of said pump housing, said first collection one-way valve mounted inside said bag extension near said first end of said bag extension to open and block movement at said first end of said bag extension;

a collection port connected to said bag extension between said first collection one-way valve and said second end of said bag extension, said collection port connected to said bag extension at a collection opening which is adapted to allow entrance of water and debris into said collection port when said pump shaft is pushed towards said connection port of said pump housing, said connection port including an exit adapted to allow exiting of water and debris from said collection port;

a second collection one-way valve which opens during pushing of said pump shaft toward said connection port of said pump housing that is adapted to allow pushing of water and debris out of said exit of said collection port and which closes during pulling of said pump shaft away from said connection port of said pump housing, said second collection one-way valve mounted inside said collection port between said collection opening and said exit of said collection port, said second collection one-way valve mounted inside said collection port to open and block movement at said exit of said collection port; and a container connected to said exit of said collection port adapted to receive water and debris from said exit of said collection port, said container including a water release adapted to allow the release of water from said container when said container receives the water and debris from said exit of said collection port.

2. The pool sweeper of claim 1, wherein said release opening is in said pump handle and wherein said open passage of said pump shaft leads into said pump handle to said release opening.

3. The pool sweeper of claim 1, further including at least one extension between said connection port of said pump housing and said bag extension.

4. The pool sweeper of claim 1, wherein said pump chamber is cylinder shaped and said plunger is disc shaped, said plunger including a seal on an outside perimeter of said plunger.

5. The pool sweeper of claim 1, further including at pump assembly extension attached to said connection port of said pump housing and a middle extension attached between said pump extension and said bag extension.

6. The pool sweeper of claim 5, wherein said middle extension telescopes in and out of said pump assembly extension to allow for a change in length from said pump housing to said first end of said bag extension.

7. The pool sweeper of claim 6, wherein said middle extension includes a seal end which is inserted into said pump assembly, said seal end including two grooves distanced about from each other about said seal end and including a flexible O-ring seal positioned in each of said two grooves to provide an air tight connection between the pump assembly extension and the middle extension.

8. The pool sweeper of claim 1, wherein said a first collection one-way valve and said second collection one-way valve are each a rubber flap hinged at an attachment point to allow said rubber flap to open and close due to pressure.

9. The pool sweeper of claim 1, wherein said container is a mesh bag, having and open end and a closed end, said open end of said mesh bag attached to said collection port adapted to allow water and debris to flow from said collection port to said mesh bag.

10. The pool sweeper of claim 9, further including an attachment device, said attachment device attached to one of said extensions and attached to said closed end of said mesh bag.

11. The pool sweeper of claim 1, further including a nozzle attached to said first end of said bag extension.

12. The pool sweeper of claim 1, wherein there is a reduction in size of said bag extension from said pump chamber.

13. The pool sweeper of claim 4, wherein there is a reduction in size of a diameter of said passage of said bag extension from said diameter of said pump chamber.

14. The pool sweeper of claim 12, wherein said reduction in size is of a ratio in a range of 6 to 8.

15. The pool sweeper of claim 13, wherein said reduction in size is of a ratio in a range of 6 to 8.

16. The pool sweeper of claim 11, wherein said nozzle is a skimmer nozzle comprising a collection surface, sides walls along said collection surface and extending upward from a top of said collection surface, an intake port opening in said top of said collection surface, a collection tube connecting said intake port opening to said first end of said bag extension.

* * * * *